United States Patent [19]

Kearns

[11] Patent Number: 4,593,935

[45] Date of Patent: Jun. 10, 1986

[54] CONDITIONALLY SELF-COPYING STATIONERY

[75] Inventor: Peter J. M. Kearns, Cardiff, Wales

[73] Assignee: Burroughs Corporation, Detroit, Mich.

[21] Appl. No.: 644,901

[22] Filed: Aug. 28, 1984

[30] Foreign Application Priority Data

Sep. 16, 1983 [GB] United Kingdom ..... 8324849

[51] Int. Cl.[4] ..... B41L 1/16; B41L 1/20; B41M 5/00

[52] U.S. Cl. ..... 282/28 R; 282/27 R; 427/153

[58] Field of Search ..... 282/8 R, 27 R, 28 R; 427/153; 428/488.1, 488.4, 321.5, 402.2; 106/14.5

[56] References Cited

U.S. PATENT DOCUMENTS

| | | | |
|---|---|---|---|
| 3,295,867 | 1/1967 | Stein | 282/27 R |
| 3,893,714 | 7/1975 | Paulson et al. | 282/28 R |
| 3,911,195 | 10/1975 | Schmidt et al. | 428/488.1 |
| 4,092,456 | 4/1978 | Newman et al. | 427/153 |
| 4,098,947 | 7/1978 | Schmidt et al. | 427/153 |
| 4,143,891 | 3/1979 | Neubauer | 427/153 |
| 4,165,101 | 8/1979 | Sternberg et al. | 427/153 |
| 4,172,605 | 10/1979 | Welsch et al. | 427/153 |

*Primary Examiner*—Paul A. Bell
*Assistant Examiner*—Paul M. Heyrana, Sr.
*Attorney, Agent, or Firm*—Kevin R. Peterson

[57] ABSTRACT

Conditionally self-copying stationery is provided wherein a carbon copy of handwritten material can be made dependently upon the attitude of insertion of a copy sheet. The copy sheet has a carbon back coating on one face thereof and each of the writing sheets in a pad has a carbon front coating on the upper surface thereof. Dependently upon whether the copy sheet is inserted such that its carbon back coating makes contact with a carbon front coating or not, so a carbon copy is selectably made or not made. The copy sheet is the conventional writing guide found in writing pads, and is printed on both sides with writing guidelines.

7 Claims, 12 Drawing Figures

CONDITIONALLY SELF-COPYING STATIONERY

BACKGROUND TO THE INVENTION

1. Field of the Invention

The present invention relates to stationery to be written upon by hand supplied in the form of a pad with many overlying sheets. The invention most particularly relates to such a pad of stationery wherein it may be desired to provide a carbon copy of what is written.

The term "carbon copy" is hereinbefore and hereinafter defined as a facsimile copy of a written message produced on a further sheet of stationery in consequence of the pressure on a first sheet of stationery during its being written.

2. The Prior Art

It is well-known in the art to provide a pad of handwriting paper in the form of a block of sheets. The sheets overlie one another and further overlie a backing card which gives stiffness to the pad. It is also well-known to provide the pad with a writing guide sheet which is detached and placed beneath a page to be written on. The guide sheet is provided with lines which are visible through the sheet to be written on and which provide guide lines for handwriting.

It is further well-known to employ a sheet of carbon paper to make a copy of a handwritten message on a subsequent sheet in such a pad of paper. Most users of such pad on some occasions wish to keep a copy of what is written in the event of its being necessary to retain a record of what is written and, on other occasions, do not require to keep a copy. As an example, if such a pad is used for personal correspondence, then letters of business may be such that it is desired to keep a record of what is written, whereas personal letters require no such record. Such pads are also preprinted and used for the writing of computer software, purchase orders, interoffice memos and the like. Depending upon the nature of the matter written on the pad, and upon whether the matter written on the pad is written by way of experimentation or as a permanent result, it may or may not be desired to keep a record. It is common practice to provide such pads with a sheet of carbon paper which can be inserted when it is desired to keep a permanent record. The carbon paper is messy, wears out, and is readily lost. It is not, therefore, convenient to provide a sheet of carbon paper with such a pad.

It is further well-known in the art to provide self-copying paper. A sheet of paper can be coated with a substance or substances which cause coloration when subjected to pressure. Two-part dies and mutually-cooperating surfaces have made it possible to coat one sheet of paper with one material, and another sheet of paper with another material, the two materials cooperating when in contact and under the influence of pressure to leave a mark on one of the sheets of paper. Examples of cooperative two-part pressure-sensitive dies and methods of encapsulating them and coating paper are to be found in U.S. Pat. No. 2,711,375, U.S. Pat. No. 2,800,457, U.S. Pat. No. 2,800,458, U.S. Pat. No. 3,041,288, U.S. Pat. No. 3,208,951, U.S. Pat. No. 3,865,613, U.S. Pat. No. 4,233,060, U.S. Pat. No. 4,263,344 and United Kingdom Pat. No. 1,232,347.

A carbon front coating and a carbon back coating are hereinafter defined as a pair of coatings for application to paper, said carbon front coating and said carbon back coating being cooperative, when brought into contact with one another and pressure applied therebetween to leave a recorded mark on said carbon front coating and not to leave a mark upon said carbon back coating.

With reference to a pad of stationery, the terms "top" and "bottom" and "upper" and "lower" are hereinafter defined as being those directions appropriately so-named when said pad is lying with its sheets of stationery in a horizontal position.

SUMMARY OF THE INVENTION

The present invention consists in a pad of stationery for hand-written information, said pad including a plurality of stacked writing sheets each having a top surface and a bottom surface, said pad comprising a selectably-insertable copy sheet having first and second faces, said top surface of said each of said plurality of writing sheets comprising a carbon front coating, said bottom surface of said each of said plurality of writing sheets comprising neither a carbon front coating nor a carbon back coating, said second face of said copy sheet comprising neither a carbon front coating nor a carbon back coating, and said first face of said copy sheet comprising a carbon back coating, such that, with said copy sheet inserted with said first face uppermost between an upper one of an adjacent pair of said plurality of writing sheets and a lower one of said adjacent pair of said plurality of writing sheets, no record is producable on said lower one of said adjacent pair of said plurality of writing sheets in consequence of writing pressure upon said upper one of said adjacent pair of said plurality of writing sheets, and such that, with said copy sheet inserted between said lower and upper ones of said adjacent pair of writing sheets with said second face uppermost, a record is producable upon said lower one of said adjacent pair of writing sheets in consequence of writing pressure upon said upper one of said adjacent pair of writing sheets.

BRIEF DESCRIPTION OF THE PREFERRED EMBODIMENT

In a preferred embodiment, a pad comprises a block of a plurality of writing sheets, preferably more than two. The pad further comprises a copy sheet. The copy sheet has first and second faces. The first face of the copy sheet comprises a carbon back coating. The second face of the copy sheet has neither a carbon front coating nor a carbon back coating thereon. The copy sheet is preferably provided atop the pad as a separately detachable sheet. The writing sheets in the pad are preferably individually detachable.

Each of the writing sheets comprises an upper surface and a lower surface. The upper surface of each of the writing sheets comprises a carbon front coating. The lower surface of each of the writing sheets is free of both a carbon front coating and a carbon back coating.

In the preferred embodiment the copy sheet provides a secondary use as a writing guide, in which case the copy sheet is preferably printed upon both sides with writing guidelines.

When it is desired to use the pad without making a copy but employing the writing guidelines, the copy sheet is inserted between the uppermost one of the writing sheets and the next writing sheet with the first face of the copy sheet uppermost. Since no carbon front coating is adjacently disposed to a carbon back coating, no copy is made upon the next sheet in the pad.

When it is desired to make a copy of a written record, the copy sheet is inserted between the uppermost one of the writing sheets and the next consequent writing sheet with the second face of the copy sheet uppermost. The carbon back coating of the copy sheet lies adjacent to the carbon front coating of the next sheet in the pad and writing pressure upon the top most writing sheet produces a copy in the subsequent writing sheet.

The pad preferably comprises a protective front cover and a supportive rear card.

BRIEF DESCRIPTION OF THE DRAWINGS

The invention is further explained, by way of example, by the following description read in conjunction with the appended drawings in which.

DETAILED DESCRIPTION OF THE PREFERRED EMBODIMENT

Figure 1:
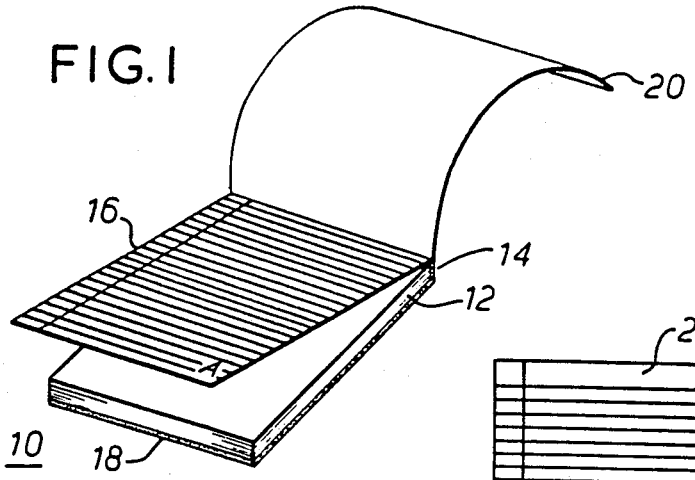
FIG. 1 shows the various components of the pad which is the preferred embodiment of the present invention.

FIG. 1 shows stationery according to the preferred embodiment of the invention.

A pad 10 comprises a block 12 of writing sheets. The block 12 consists in a great many identical writing sheets affixed one above the other. The writing sheets are attached along a common edge by binding, staples, glue or any other means known in the art. The writing sheets in the block 12 are individually detachable. Depending upon the manner of collective attachment, the writing sheets in the block may be individually removed by tearing away from a common glue backing or by the severing of perforated lines proximate to the commonly-bound edge. In the preferred embodiment here shown, the writing sheets in the block are held by glue along a common spine 14. It is to be appreciated that this manner of attachment is for preference only, and any of the variations hereinbefore described can be employed.

A copy sheet writing guide 16 is attached to the spine 14 atop the block of writing sheets 12. The block of writing sheets 12 is supported by a stiff board backing 18 and the pad 10 is further provided with a cover 20 which can be closed for the protection of the whole.

Figure 2:
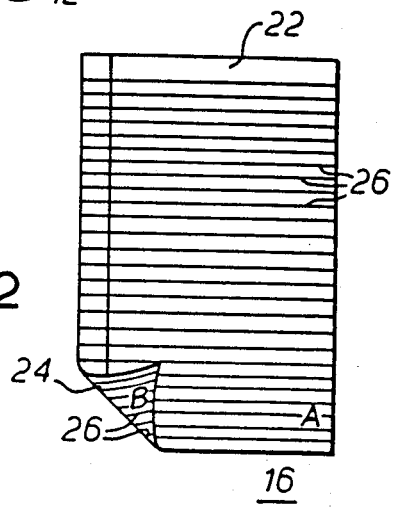
FIG. 2 shows detail of the front and back surfaces of the copy sheet of FIG. 1.

FIG. 2 shows the copy sheet writing guide 16. The copy sheet writing guide 16 comprises a first face 22 generally designated in the Figures by having the letter 'A' in the bottom righthand corner thereof. The copy sheet writing guide 16 further comprises a second face 24 generally designated in the Figures by having the letter 'B' in the bottom right-hand corner thereof. While, in the preferred embodiment, the first and second faces 22,24 of the copy sheet writing guide are distinguished from one another by having different letters printed on either side thereof, other means may be employed for distinguishing the two faces 22,24. For example, the two faces may be of different colors or texture, or may have explicitely distinguishing legends, explanatory of use, printed thereon. Both the first face 22 and the second face 24 have guide lines 26 printed thereon. The guide lines are those conventionally found upon the writing guide of a pad of paper and intended to be visible through a writing sheet for the guidance of the writer. The copy sheet writing guide 16 can therefore be used as a writing guide with either the first face 22 or the second face 24 uppermost. Whilst in the preferred embodiment the guidelines 26 are shown appropriately for a conventional writing pad, the guidelines 26 may be of a more complex or specialized nature. It is envisaged that the guidelines can be suitable for filling in forms, writing purchase orders, recording computer programs and any of a host of other applications.

Figure 3A:
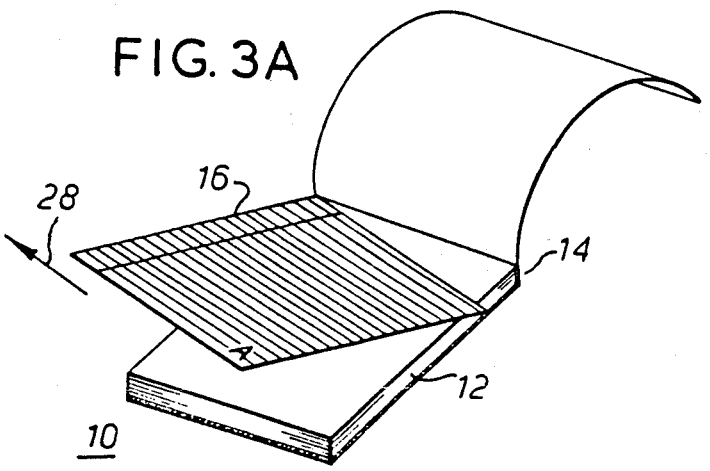
FIGS. 3A, 3B, 3C and 3D show the sequence whereby the guidelines on the copy sheet may be employed without making a carbon copy.

FIG. 3A shows the first stage in using the pad 10 without creating a carbon copy record of what is written. The copy sheet writing guide 16 is torn, as indicated by a first arrow 28, from the spine 14 to be free of the top of the block 12 of writing sheets. This action is only necessary if the pad 10 has never been used before.

Figure 3B:
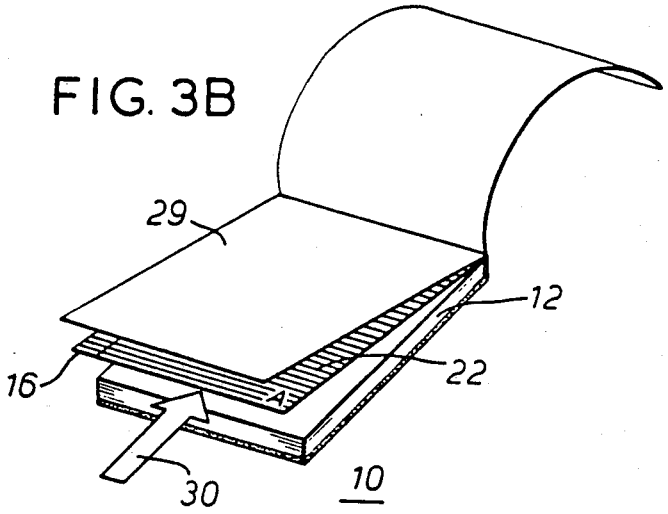

FIG. 3B shows the second stage in the use of the pad 10 without making a carbon copy record. The topmost writing sheet 29 is raised and the copy sheet writing guide 16 is inserted as indicated by the second arrow 30 between the topmost writing sheet and the block 12 of writing sheets with the first face 22 uppermost.

Figure 3C:
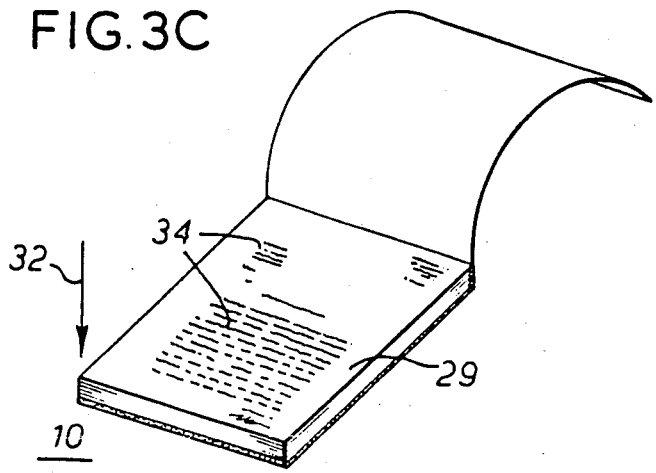

FIG. 3C shows the third stage of using the pad 10 without making a carbon copy record. The topmost writing sheet 29 is closed, as generally indicated by the third arrow 32, and written information 34 is written thereon.

Figure 3D:
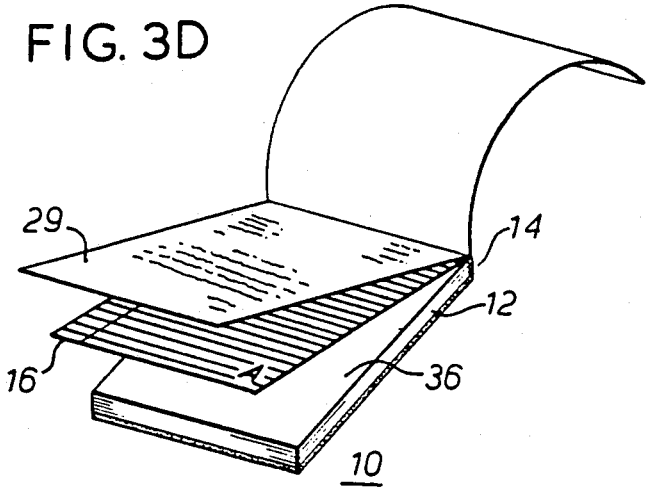

FIG. 3D shows the fourth and final stage of using the pad 10 without making a carbon copy record. The topmost writing sheet 29 is lifted prior to being torn along the spine 14. The copy sheet writing guide 16 is removable for reuse. There is no carbon copy of any kind either upon the subsequent writing sheet 36 or upon the underside of the topmost writing sheet 29.

Figure 4A:
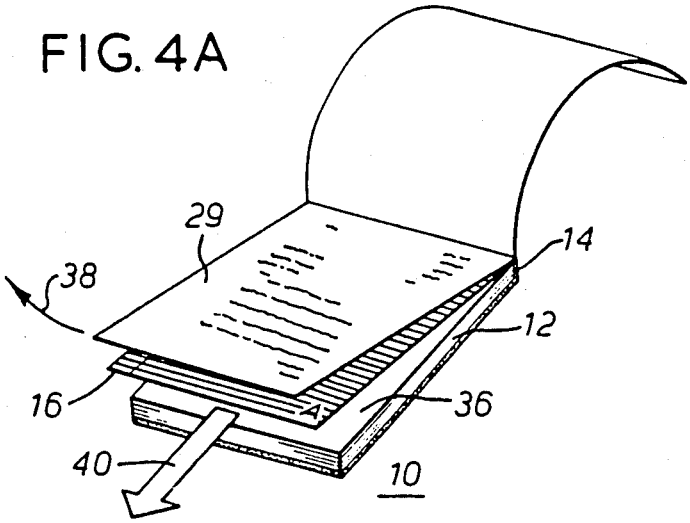
FIGS. 4A, 4B, 4C and 4D show the sequence whereby a carbon copy can be used using the copy sheet.

FIG 4A shows the first part of a sequence of actions leading to the use of the pad 10 where a carbon copy record is maintained. The topmost writing sheet 29 is torn from the spine 14, as indicated by a fourth arrow 38, for use elsewhere. The copy sheet writing guide 16 is removed from above the subsequent writing sheet 36 as indicated by a fifth arrow 40. The action shown in FIG. 4A is only necessary in consequence of the position shown in FIG. 3D. In those circumstances where carbon copy use of the pad 10 is intended without previous non-carbon copy use, it is simply necessary that the copy sheet writing guide 16 be free of the spine 14 and that no writing be visible on the block 12.

Figure 4B:
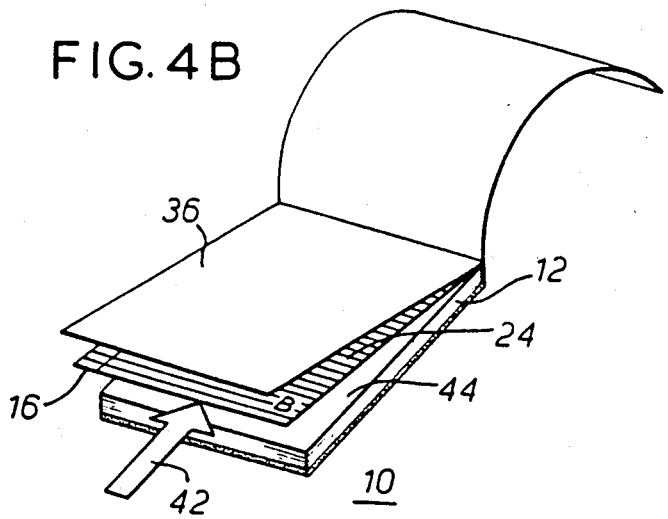

FIG. 4B shows the second stage in the use of the pad 10 where it is desired to make a carbon copy. The copy sheet writing guide 16 is flipped over so that its second face 24 is uppermost and is inserted as indicated by a sixth arrow 42 to lie between the subsequent writing sheet 36 and the next subsequent writing sheet 44 of the block 12.

Figure 4C:
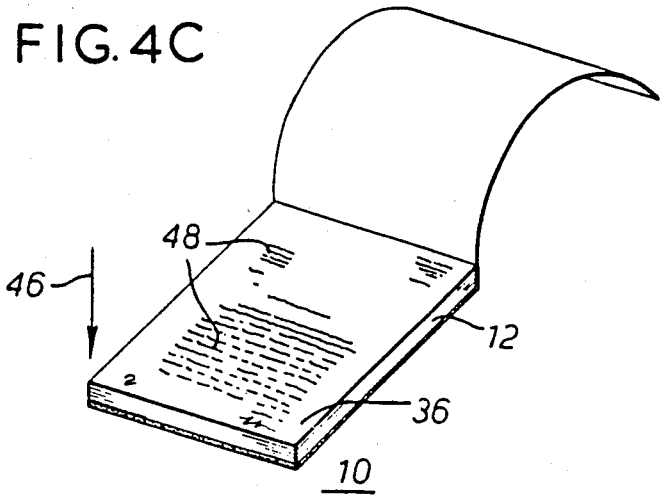

FIG. 4C shows the third stage in using the pad 10 where it is desired to make a carbon copy record. The subsequent writing sheet 36 is closed over the block 12 as indicated by a seventh arrow 46 and further written information 48 is written thereon.

Figure 4D:
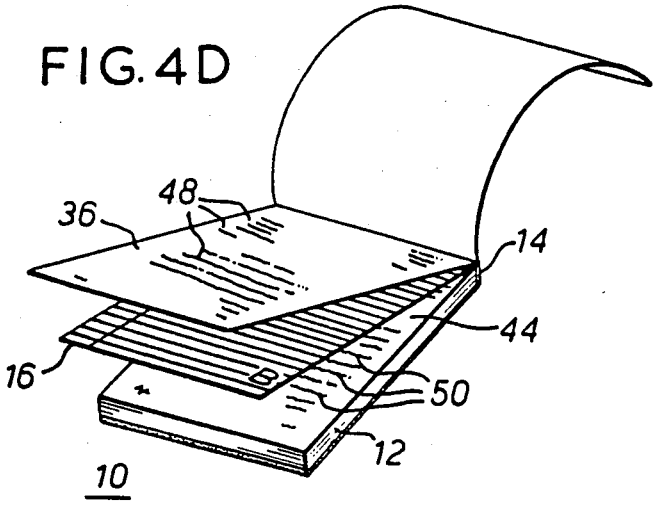

FIG. 4D shows the fourth and last stage in using the pad 10 where it is desired to make a carbon copy record. When the subsequent writing sheet 36 is raised from the block 12, a carbon copy record 50 of the further written information 48 is found upon the next subsequent writing sheet 44 and is made in consequence of the writing pressure during the writing of the further written information 48. The subsequent writing sheet 36, the copy sheet writing guide 16 and the next subsequent writing sheet 44 can all be removed from the pad 10 and the copy sheet writing guide 16 reused as desired either for making, or avoiding the making, of a carbon copy 50.

Figure 5A:
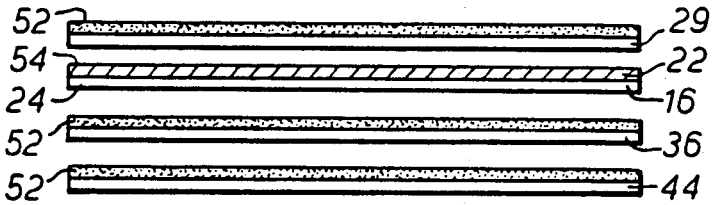
FIG. 5A shows, in exaggerated vertical cross-section, the disposition of the various sheets when the sequence shown in FIGS. 3A to 3D is followed.
Figure 5B:
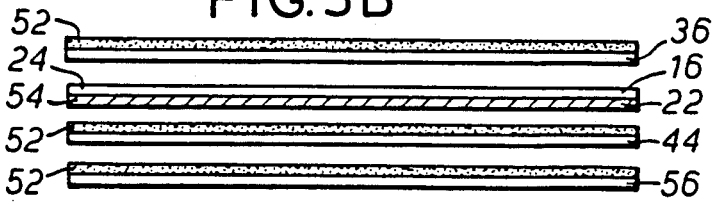
FIG. 5B shows the disposition of the various sheets when the sequence shown in FIGS 4A to 4D is followed.

FIG. 5A shows a cross-sectional view with exaggerated vertical scale through part of the pad 10 as seen in FIG. 3C. The topmost writing sheet 29, the subsequent writing sheet 36 and the next subsequent writing sheet 44 all have a carbon front coating 52 on the upper surface thereof. The copy sheet writing guide 16 has a carbon back coating on the first face thereof. The lower face of each of the writing sheets 29,36,44 has neither a carbon front coating nor a carbon back coating. The copy sheet writing guide 16 has neither a carbon front coating 52 nor a carbon back coating 54 on the second face 24 thereof. Thus, no carbon front coating 52 in any of the writing sheets 29,36,44 comes into contact with the carbon back coating 54 on the copy sheet writing guide 16. Writing pressure on the topmost writing sheet 29 therefore has no effect and no carbon copy is produced.

It is to be appreciated that each and every single one of the plurality of writing sheets in the block 12 has a carbon front coating on the top surface thereof. Similarly, each and every writing sheet in the block 12 has neither a carbon front coating 52 nor a carbon back coating 54 on the bottom surface thereof.

FIG. 5A shows a cross-sectional view through part of the pad 10 corresponding to FIG. 4C where it is desired to make a carbon copy. The copy sheet writing guide 16 is reversed compared to FIG. 5A such that the carbon back coating 54 is in contact with the carbon front coating 52 on the top surface of the next subsequent writing sheet 44. The next subsequent writing sheet 44 lies atop further writing sheets 56. When writing pressure is applied to the top surface of the upper writing sheet 36, the writing pressure causes interaction between the carbon front coating 52 on the top surface of the next subsequent writing sheet 44, and the carbon back coating 54 on the first face of the copy sheet writing guide 16 to create the carbon copy 50 shown in FIG. 4D.

Any two-part pressure-sensitive coating system may be used to embody the present invention provided that the carbon front coating 52 permits writing thereupon. In the embodiment of the present invention the system used is the same as that employed in "IDEM" (Trademark) copying paper, but it is to be appreciated that other two-part coating systems can equally be employed.

The writing sheets are here shown, in the preferred embodiment, as being plain. The writing sheets can have printing on the top face thereof when it is intended that the pad 10 should be used for specific purposes such as for making purchase orders, for writing inter-office memos and for recording computer programs.

Whilst in the preferred embodiment hereinbefore described the carbon front coating 52 and the carbon back coating 54 are continuous over their respective surfaces, the coatings 52,54 can be made interactive only over selected parts of each writing sheet such that only certain elements of the written information are recorded.

What I claim is:

1. A pad of stationery for hand-written information, said pad including a plurality of stacked writing sheets each having a top surface and a bottom surface, said pad comprising a selectably-insertable copy sheet haveing first and second faces, said top surface of said each of said plurality of writing sheets comprising a carbon front coating, said bottom surface of said each of said plurality of writing sheets comprising neither a carbon front coating nor a carbon back coating, said second face of said copy sheet comprising neither a carbon front coating nor a carbon back coating, and said first face of said copy sheet comprising a carbon back coating, such that, with said copy sheet inserted with said first face uppermost between an upper one of an adjacent pair of said plurality of writing sheets and a lower one of said adjacent pair of said plurality of writing sheets, no record is producible on said lower one of said adjacent pair of said plurality of writing sheets in consequence of writing pressure upon said upper one of said adjacent pair of said plurality of writing sheets, and such that, with said copy sheet inserted between said lower and upper ones of said adjacent pair of writing sheets with said second face uppermost, a record is producible upon said lower one of said adjacent pair of writing sheets in consequence of writing pressure upon said upper one of said adjacent pair of writing sheets, said copy sheet including writing guidelines, visible through the upper ones of said adjacent pair of writing sheets, upon said first face and upon said second face thereof.

2. A pad of stationery according to claim 1 wherein said plurality of stacked writing sheets are detachably held along a common spine, are supported in common by a backing board, and are provided with a cover, said copy sheet being affixed to said spine between said cover and said plurality of writing sheets.

3. A pad of stationery according to claim 1 wherein said plurality of stacked writing sheets are detachably held along a common spine, are supported in common by a backing board, and are provided with a cover, said copy sheet being affixed to said spine between said cover and said plurality of writing sheets.

4. A pad of stationery according to claim 1, wherein said first face of said copy sheet is marked with a first legend, and wherein said second face of said copy sheet is marked with a second legend.

5. A pad of stationery according to claim 1, wherein said first face of said copy sheet is marked with a first legend, and wherein said second face of said copy sheet is marked with a second legend.

6. A pad of stationery according to claim 2, wherein said first face of said copy sheet is marked with a first legend, and wherein said second face of said copy sheet is marked with a second legend.

7. A pad of stationery according to claim 3, wherein said first face of said copy sheet is marked with a first legend, and wherein said second face of said copy sheet is marked with a second legend.

* * * * *